US009845525B2

(12) United States Patent
Yamamoto et al.

(10) Patent No.: US 9,845,525 B2
(45) Date of Patent: Dec. 19, 2017

(54) EQUIPMENT SYSTEM FOR PRODUCING PIERCING-ROLLING PLUG

(71) Applicant: NIPPON STEEL & SUMITOMO METAL CORPORATION, Tokyo (JP)

(72) Inventors: Tomohiro Yamamoto, Tokyo (JP); Yasuyoshi Hidaka, Tokyo (JP); Yasuto Higashida, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 595 days.

(21) Appl. No.: 14/395,156

(22) PCT Filed: Mar. 19, 2013

(86) PCT No.: PCT/JP2013/001859
§ 371 (c)(1),
(2) Date: Oct. 17, 2014

(87) PCT Pub. No.: WO2013/161177
PCT Pub. Date: Oct. 31, 2013

(65) Prior Publication Data

US 2015/0075241 A1 Mar. 19, 2015

(30) Foreign Application Priority Data

Apr. 24, 2012 (JP) ..... 2012-098767

(51) Int. Cl.
*B21B 25/00* (2006.01)
*C23C 4/12* (2016.01)
(Continued)

(52) U.S. Cl.
CPC ..... *C23C 4/125* (2013.01); *B21B 19/04* (2013.01); *B21B 25/00* (2013.01); *B24C 3/32* (2013.01);
(Continued)

(58) Field of Classification Search
CPC B21B 25/00; B21B 19/04; C23C 4/02; C23C 4/06; C23C 4/08; C23C 4/131; C23C 4/125; B24C 3/32
(Continued)

(56) References Cited

U.S. PATENT DOCUMENTS

2010/0050723 A1* 3/2010 Hidaka ..... B21B 25/00 72/97

FOREIGN PATENT DOCUMENTS

JP 60-136355 9/1985
JP 4279350 6/2009
(Continued)

*Primary Examiner* — David B Jones
(74) *Attorney, Agent, or Firm* — Clark & Brody

(57) ABSTRACT

Provided is an equipment system for producing a piercing-rolling plug to be used for producing a seamless steel tube/pipe, which includes a shotblasting device for applying shotblasting on a surface of the plug, and an arc-spraying device for performing arc-spraying of iron wires on a surface of a base metal of the plug to which the shotblasting is applied, so as to form a film containing oxide and Fe thereon. The arc-spraying device includes plural spraying booths each of which separately forms part of the film in turn in each of sections into which the surface of the base metal of the plug is divided along an axial direction of the plug. The production efficiency of the plug can therefore be maintained at a high level, and steady enhancement of the durability life of the plug can be realized during the piercing-rolling.

8 Claims, 8 Drawing Sheets

(51) Int. Cl.

| | |
|---|---|
| ***B21B 19/04*** | (2006.01) |
| ***C23C 4/02*** | (2006.01) |
| ***B24C 3/32*** | (2006.01) |
| ***C23C 4/08*** | (2016.01) |
| ***C23C 4/06*** | (2016.01) |
| ***C23C 4/131*** | (2016.01) |

(52) U.S. Cl.
CPC ..... *C23C 4/02* (2013.01); *C23C 4/06* (2013.01); *C23C 4/08* (2013.01); *C23C 4/131* (2016.01)

(58) Field of Classification Search
USPC ..... 72/97
See application file for complete search history.

(56) References Cited

FOREIGN PATENT DOCUMENTS

| | | |
|---|---|---|
| JP | 2011-001612 | 1/2011 |
| SU | 1145049 | 3/1985 |
| WO | 2009/057471 | 5/2009 |

* cited by examiner

EQUIPMENT SYSTEM FOR PRODUCING PIERCING-ROLLING PLUG

TECHNICAL FIELD

The present invention relates to an equipment system for producing a piercing-rolling plug to be used in a piercing-rolling mill (hereinafter, also referred to simply as a "piercer") that produces a seamless steel tube/pipe, particularly to an equipment system for producing a piercing-rolling plug having a film formed by performing arc-spraying of iron wires on a surface of a plug base metal.

BACKGROUND ART

A seamless steel tube/pipe is produced by the Mannesmann tube-making process. The Mannesmann tube-making process includes the following steps:

(1) piercing-rolling a starting material (round billet) heated at a predetermined temperature into a hollow shell by using a piercer;

(2) elongation-rolling the hollow shell by an elongation rolling mill (e.g. mandrel mill); and (3) carrying out diameter adjusting rolling on the elongation-rolled hollow shell to have a predetermined outer diameter and wall thickness by using a diameter adjusting rolling mill (e.g. a stretch reducer).

In the piercing-rolling by using the piercer, a plug is used as a piercing tool. This plug is mounted to a front end of a core bar so as to pierce a billet heated at a high temperature of approximately 1200° C.; thus the plug is subjected to a hostile environment with a high surfacial pressure and a high temperature. In general, the plug includes a base metal made of hot working tool steel, and a film of oxide scale is formed on a surface of the base metal through a heating process in advance for the purpose of protection of the base metal, and thereafter the plug is used in the piercing-rolling. During the piercing-rolling, the scale film on the surface of the plug insulates heat transfer from the billet to the base metal of the plug, and also prevents seizing between the billet and the plug.

Repetitive piercing-rolling of such a plug having the scale film causes a gradual abrasion of the scale film. The abrasion of the scale film deteriorates thermal insulation effect of the film, resulting in increase in temperature of the plug during the piercing, so that melting-incurred metal loss and deformation by heat are likely to be caused to the plug base metal. If the scale film is exhausted, and the plug base metal comes into direct contact with the billet, seizing is caused, so as to generate flaws on an internal surface of a steel tube/pipe. Consequently, the plug becomes unusable at the moment when the film is exhausted, and its durability life is expired.

Particularly in production of a seamless steel tube/pipe made of high alloy steel such as high Cr steel containing Cr of 9% or more, Ni-based alloy, and stainless steel, significant abrasion of the scale film on the surface of the plug is generated during the piercing-rolling, so that the durability life of the plug becomes significantly reduced. For example, in the case of piercing stainless steel, the scale film on the surface of the plug becomes worn away through two or three passes (the number of times of continuous piercing rolling), and the durability life of this plug is expired. This requires a frequent replacement of the plug, which deteriorates the production efficiency. In production of a seamless steel tube/pipe of high alloy steel, it is required to enhance the durability life of the plug during the piercing-rolling, thereby enhancing the production efficiency of the steel tube/pipe.

To satisfy such a requirement, as an example of the film formed on the surface of the plug base metal, Patent Literature 1 discloses such a plug having a film containing oxide and Fe formed on the surface of the plug base metal by performing arc-spraying of iron wires, instead of using the scale film formed through heat treatment. Since the plug having the arc-sprayed film has a film containing oxide and Fe on the surface of the plug, this plug is excellent in thermal insulation performance and seizing prevention, so that enhancement of the durability life of the plug is likely to be achieved.

Patent Literature 1 discloses an equipment system of producing (reproducing) a plug having an arc-sprayed film by forming the film containing oxide and Fe on a surface of a base metal of the plug in such a manner that, after shotblasting is applied onto the surface of the plug, molten material is sprayed from arc-spray guns onto the surface of the plug base metal while a turntable on which the plug is mounted is being rotated. In this equipment system, the spray guns are so disposed as to face a tip end portion, a front-half of the body portion, and a rear-half of the body portion of the surface of the plug base metal, and forms the arc-sprayed film by operating all the spray guns at the same time, thereby reducing time required for forming the film compared to the case of using a single spray gun to form the arc-sprayed film across the entire surface of the plug base metal, which results in enhancement of production efficiency of the plug.

Unfortunately, even in the plug having the arc-sprayed film formed by using the conventional equipment system disclosed in Patent Literature 1, there occurs separation of the film if a billet length to be pierced is long, or if a billet having elevated-temperature strength is used. As such, there is still room for further improvement in securing the steadily enhanced durability life of the plug, and thus it has been strongly desired to produce a piercing-rolling plug that can realize the above improvement.

CITATION LIST

Patent Literature

Patent Literature 1: Japanese Patent No. 4279350

SUMMARY OF INVENTION

Technical Problem

An object of the present invention, which has been made in order to solve the problems according to the conventional art, is to provide an equipment system for producing a r piercing-rolling plug having a film containing oxide and Fe formed on a surface of the plug base metal by performing arc-spraying of iron wires, and the equipment system has the following features of:

(1) maintaining production efficiency of the plug at a high level; and (2) securing steady enhancement of the durability life of the plug even if a billet length to be pierced is long, or even if a billet having high elevated-temperature strength is used.

Solution to Problem

The summary of the present invention is as follows.

Provided is an equipment system for producing a piercing-rolling plug to be used for producing a seamless steel tube/pipe, and the equipment system for producing the r piercing-rolling plug comprises:

a shotblasting device for applying shotblasting on a surface of the plug; and an arc-spraying device for performing arc-spraying of iron wires on a surface of a base metal of the plug to which the shotblasting is applied, so as to form a film containing oxide and Fe thereon.

The arc-spraying device includes plural spraying booths each of which is used to separately form part of the film in turn in each of sections into which the surface of the base metal of the plug is divided along an axial direction of the plug.

In this equipment system, it is preferable that an arc-spray gun for melting the iron wires by an arc, and spraying molten material thereof onto the surface of the base metal of the plug is disposed in each arc-spraying booth, and the arc-spraying is carried out while an intersection angle between the center line of a spraying stream from the arc-spray gun and the surface of the base metal of the plug is maintained in a range of 35 degrees to 90 degrees.

In the above described equipment system, it is preferable that the plug has a bullet shape, and includes a body portion and a tip end portion, and the arc-spraying device includes, as the spraying booth, a first spraying booth for carrying out the film formation in a region of the body portion among the surface of the base metal of the plug, and a second spraying booth for carrying out the film formation in a region of the tip end portion among the surface of the base metal of the plug.

In the above described equipment system, the equipment system preferably further includes a conveying line for moving the plug between the spraying booths.

Advantageous Effects of Invention

The equipment system for producing a piercing-rolling plug according to the present invention achieves the following remarkable effects of:

(1) maintaining production efficiency of the plug at a high level; and (2) securing steady enhancement of the durability life of the plug even if a billet length to be pierced is long, or even if a billet having high elevated-temperature strength is used.

DESCRIPTION OF EMBODIMENTS

In order to achieve the above object, the present inventors conducted various tests and intensive studies on a method for forming a film containing Fe oxide and Fe on a surface of a plug base metal by performing arc-spraying of iron wires onto the surface of the plug base metal. As a result, the present inventors have obtained the following findings.

Figure 1:
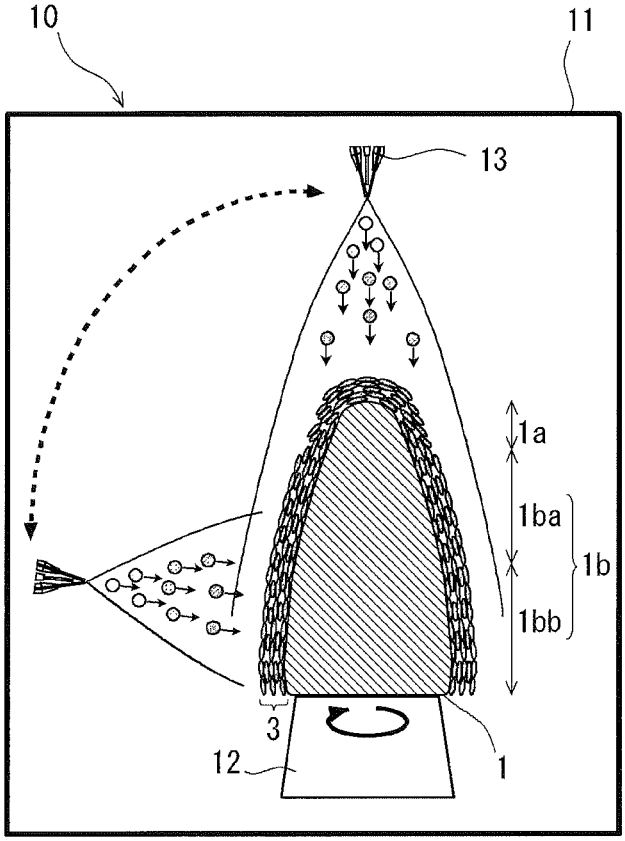
FIG. 1 is a schematic illustration showing an example of a conventional equipment system for producing a plug having an arc-spraying film.
Figure 2:
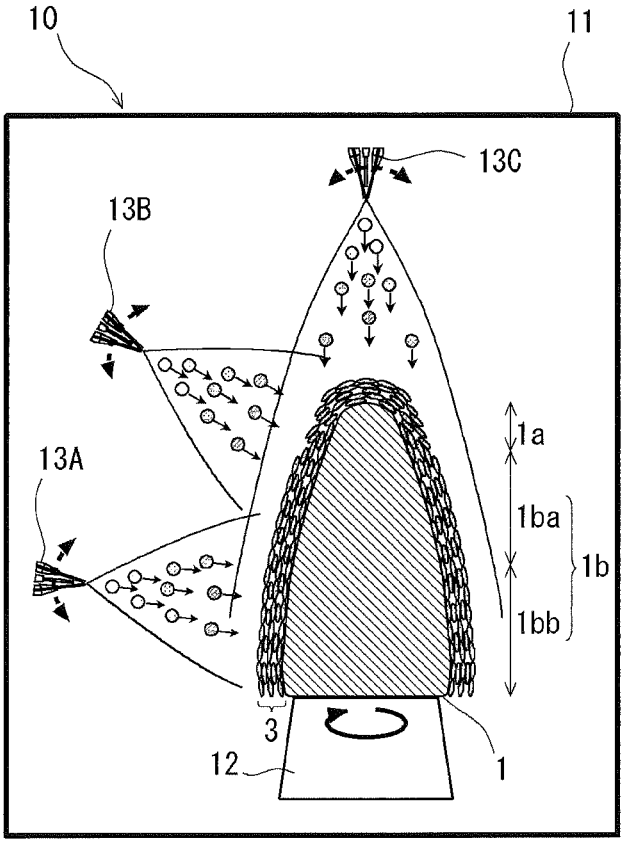
FIG. 2 is a schematic illustration showing another example of the conventional equipment system for producing the plug having the arc-spraying film.

FIG. 1 is a schematic illustration showing an example of a conventional equipment system for producing a plug having an arc-spraying film, and FIG. 2 is a schematic illustration showing another example of this system. Each of the conventional equipment systems for producing the plug shown in FIG. 1 and FIG. 2 includes an arc-spraying device 10 and a shotblasting device (not shown) disposed prior to the arc-spraying device 10.

Prior to the arc-spraying by using the arc-spraying device 10, the shotblasting is applied to the surface of the plug by using the shotblasting device. In a case of shot-blasting a plug to be reproduced after the durability life is expired through repetitive piercing-rolling, the piercing-rolled film remaining on the surface of the plug is removed through the shotblasting so as to strip the surface of the plug base metal, and make the surface of the plug base metal moderately rough. Even in case a new plug is produced, the surface of the plug base metal is allowed to be moderately rough through the shotblasting. The reason for the shotblasting treatment is because adhesiveness between the plug base metal and the arc-sprayed film is enhanced by carrying out the arc-spraying to the plug base metal having a moderate rough surface with no remaining film thereon.

The arc-spraying device 10 performs the arc-spraying with iron wires onto a surface of a base metal of a plug 1 to which the shotblasting is applied, so as to form a film 3 containing Fe oxide and Fe. As a specific system configuration, the arc-spraying device 10 of the conventional equipment systems shown in FIG. 1 and FIG. 2 includes a single booth 11 for forming the film 3. A turntable 12 rotatable about its vertical axis is disposed in the booth 11, and the plug 1 to which the shotblasting is applied is placed at the center of the turntable 12 with the tip end portion up. The plug 1 in this case has a bullet shape, and includes a tip end portion 1*a* and a body portion 1*b*. The body portion 1*b* constitutes 80 to 98% of the entire length of the plug 1 along an axial direction (vertical direction in the illustration) from a rear end (lower end in the illustration) thereof. The body portion 1*b* is divided into a front-half 1*ba* on the tip end side, and a rear-half (reeling portion) 1*bb* on the rear end side.

In the conventional equipment system shown in FIG. 1, a single arc-spray gun 13 is disposed in the sole spraying booth 11. The arc-spray gun 13 melts the iron wires by the arc, and sprays this molten material. Hereinafter, for purposes of explanatory convenience, the conventional equipment system shown in FIG. 1 is referred to as the "conventional equipment system 1". The spray gun 13 thereof is mounted to an articulated arm operated by programming, and is configured to be reciprocatingly movable along the surface of the base metal from the rear end to the tip end of the plug 1.

In the conventional equipment system 1, during the formation of the film 3 on the surface of the base metal of the plug 1 through the arc-spraying, the only one spray gun 13 is operated while the plug 1 is being rotated about its central axis along with the rotational movement of the turntable 12 in the sole spraying booth 11. In this manner, the film 3 is formed across the entire surface from the tip end portion 1*a* to the body portion 1*b* of the plug 1.

On the other hand, in the conventional equipment system shown in FIG. 2, three spray guns 13A, 13B and 13C for melting the iron wires by the arc so as to spray the molten material are disposed in the sole spraying booth 11. Hereinafter, for purposes of explanatory convenience, the conventional equipment system shown in FIG. 2 is referred to as the "conventional equipment system 2". The three spray guns 13A, 13B and 13C are mounted to respective articulated arms which are operated by different programming. The first spray gun 13A of the three spray guns reciprocatingly moves along the region of the rear-half 1*bb* of the body portion 1*b* among the surface of the base metal of the plug 1. The second spray gun 13B thereof reciprocatingly moves along the region of the front-half 1*ba* of the body portion 1*b* among the surface of the base metal of the plug 1. The third spray gun 13C thereof reciprocatingly moves along the region of the tip end portion 1*a* among the surface of the base metal of the plug 1.

In the conventional equipment system 2, during the formation of the film 3 on the surface of the base metal of the plug 1 through the arc-spraying, the three spray guns 13A, 13B and 13C are operated at the same time while the plug 1 is being rotated about the central axis along with the rotational movement of the turntable 12 in the sole spraying booth 11. In this manner, the film 3 is formed across the entire surface from the tip end portion 1*a* to the body portion 1*b* of the plug 1.

Accordingly, both the conventional equipment systems 1 and 2 can produce the plug having the arc-sprayed film in which the film 3 containing oxide and Fe is formed across the entire surface of the base metal of the plug 1 by arc-spaying the iron wires on the surface of the base metal of the plug 1.

Focused on adhesiveness of the film in the plug having the arc-sprayed film, basic tests were conducted.

Figure 3:
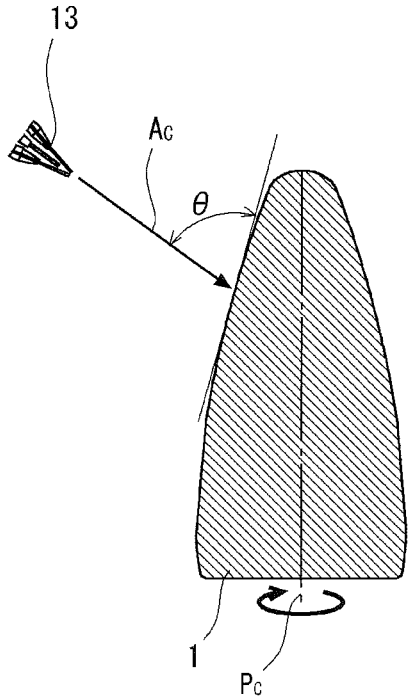
FIG. 3 is a schematic illustration showing the state of the arc-spraying conducted in basic tests for investigating adhesiveness of the arc-sprayed film.

FIG. 3 is a schematic illustration showing the state of the arc-spraying conducted in the basic tests for investigating the adhesiveness of the arc-sprayed film. As shown in this illustration, in the basic tests for investigating the adhesiveness of the film, molten material resulted from the iron wires is sprayed from the arc-spray gun 13 while the plug 1 is being rotated about the central axis Pc of the plug 1, so as to form the film on the surface of the plug 1. At this time, various films were formed by varying an intersection angle θ defined by the center line Ac of a spraying stream from the arc-spray gun 13 and the surface of the base metal of the plug 1. As an evaluation procedure of the adhesiveness of the film, a peel stress in the shear direction of the film (hereinafter referred to as "adhesiveness") was measured for each of the plugs 1 having the different intersection angles, referred to as θ. The film adhesiveness for the plug having the intersection angle θ of 90 degrees was defined as the reference "1", and the evaluation of film adhesiveness was conducted based on the ratio of the film adhesiveness (adhesiveness ratio) of each plug having a different intersection angle θ relative to this reference. The microscopic observation of the cross section of the film of each plug was also conducted.

Figure 4:
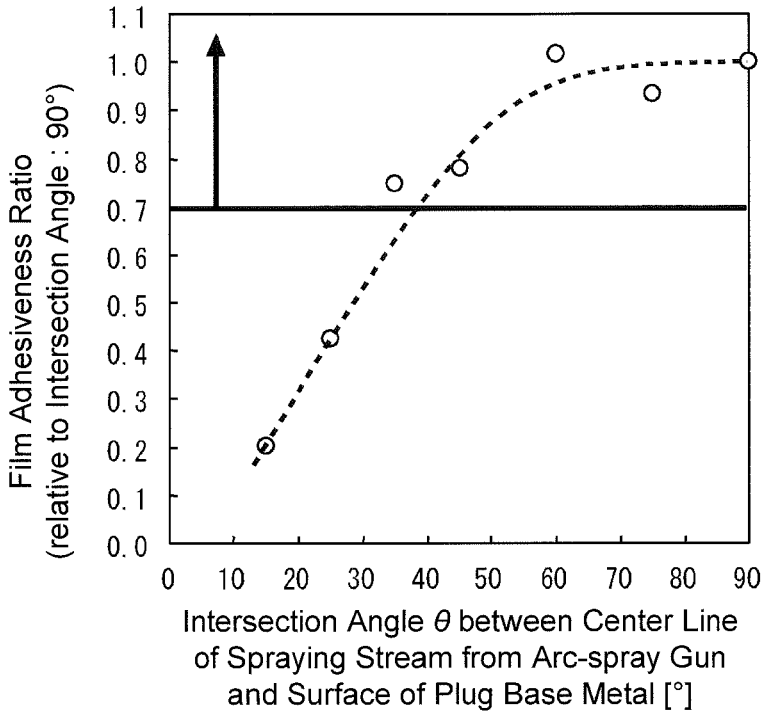
FIG. 4 is an illustration showing dependency on the intersection angle between the center line of a spraying stream of an arc-spray gun and the surface of the base metal of the plug as a result of the basic tests on the adhesiveness of the arc-sprayed film.

FIG. 4 is an illustration showing the dependency of the film adhesiveness on the intersection angle between the center line of the spraying stream of the arc-spray gun and the surface of the base metal of the plug as a result of the basic tests on the adhesiveness of the arc-sprayed film. As the result of the basic tests, FIG. 5 is an illustration showing microscopic observation photographs of the cross sections of each film depending on the intersection angle between by the center line of the spraying stream from the arc-spray gun and the surface of the base metal of the plug.

As shown in FIG. 4, the adhesiveness ratio of the film depends on the intersection angle θ between the center line of the spraying stream of the arc-spray gun and the surface of the base metal of the plug. Specifically, if the intersection angle θ is smaller than 35 degrees, the adhesiveness ratio is apt to significantly decrease. To the contrary, if the intersection angle θ is 60 degree or more, there is no sign of the decrease in the adhesiveness ratio.

Figure 5:
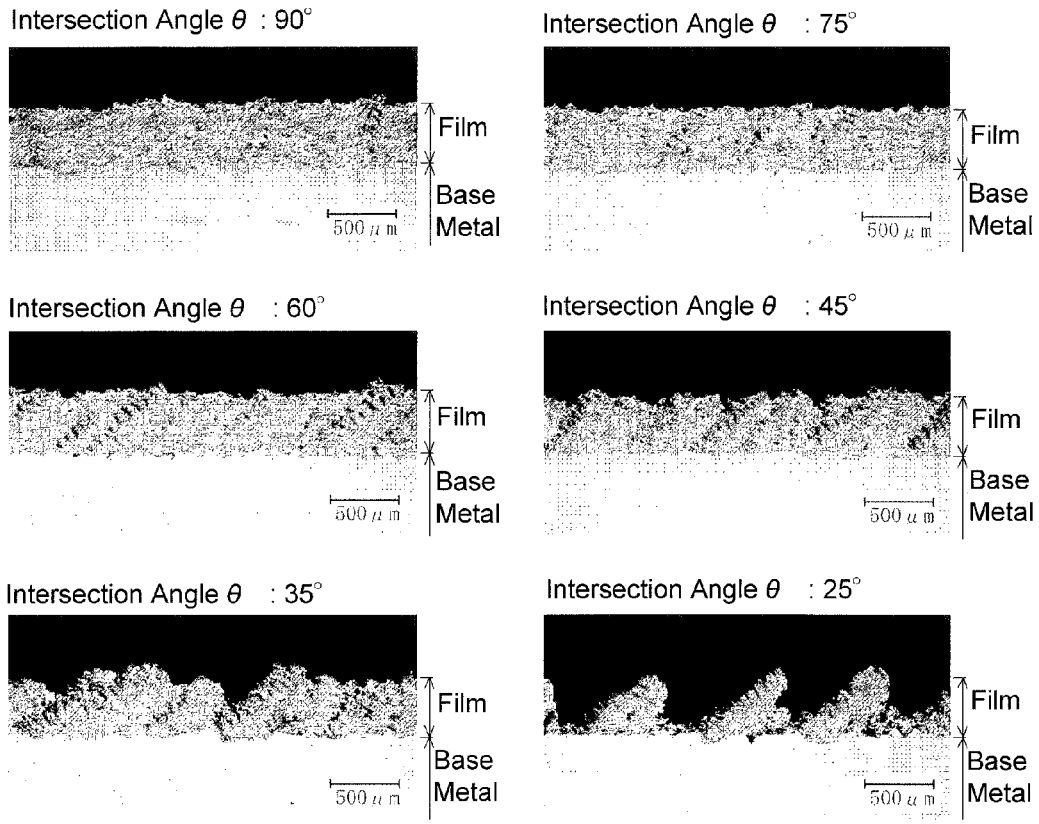
FIG. 5 is an illustration showing microscopic observation photographs of the cross section of each film depending on the intersection angle between the center line of the spraying stream of the arc-spray gun and the surface of the base metal of the plug as a result of the basic tests on the adhesiveness of the arc-sprayed film.

As shown in FIG. 5, the reason for the reduction of the adhesiveness in case of a smaller intersection angle θ is because the film might ununiformly adhere onto the surface of the plug base metal, which results in increase of the percentage of porosity in the film.

The arc-spraying is generally used in the repair of a teeming port of a metal refining vessel formed of a refractory material, or in coating on an internal surface of a cylinder bore of an engine. In this case, the target of the arc-spraying is the internal surface of a cylindrical member, and is carried out such that a spray gun is inserted in a cylindrical member that is immobilized, so that the distance between the spray gun to the target surface on which the film is to be formed, that is, the spraying distance is approximately 50 mm, or approximately 150 mm at most, which is small. In such a general arc-spraying, it is not preferable to set to the intersection angle between the center line of the spraying stream of the spray gun and the target surface for the film formation to be a large angle. If the intersection angle is large, molten material sprayed from the spray gun splashes back from the target surface for the film formation, and is then returned to the spray gun; therefore damages are caused to the spray gun, or the molten material splashed back from the target surface for the film formation is inadvertently re-sprayed onto the target surface for the film formation, which deteriorates the adhesiveness of the film; thus a larger intersection angle is not preferable in light of prevention of the above undesirable incidents.

According to this theory, there might be a risk that, in the arc-spraying for the plug as a target surface of the film formation, a larger intersection angle between the center line of the spraying stream of the spray gun and the surface of the plug base metal may also reduce the adhesiveness of the film. As described above, in the arc-spraying for the plug, however, a larger intersection angle θ rather secures enhancement of the adhesiveness of the film. The reason for this is as follows.

In a case of the arc-spraying with the iron wires to form the film containing oxide and Fe on the surface of the plug base metal, it is required to secure sufficient time for oxidizing the molten material sprayed from the spray gun in the air; thus the spraying distance from the spray gun to the surface of the plug base metal, i.e., standoff distance from the surface is approximately 200 to 1000 mm, which is relatively large. Accordingly, even if the intersection angle is set to be large, the splash back of the molten material hardly occurs on the surface of the plug base metal.

In the formation of the arc-sprayed film on the surface of the plug base metal, the arc-spraying is carried out while the plug is being rotated, the molten material that should have splashed back from the surface of the plug base metal is tremendously flicked off by the rotation of the plug, so that the molten material is prevented from inadvertently adhering to the surface of the plug base metal.

Based on the above basic tests, it is recognized that, in order to secure the adhesiveness of the film formed on the surface of the plug as well as allow this adhesiveness to have sufficient strength, it is preferable to maintain the intersection angle θ between the center line of the spraying stream from the arc-spray gun and the surface of the base metal of the plug within the range of 35 degrees to 90 degrees while the arc-spraying is being carried out to form the arc-sprayed film on the surface of the plug base metal. It is more preferable to set the intersection angle θ within the range of 60 degrees to 90 degrees.

An example of an equipment system for carrying out the arc-spraying with the intersection angle θ within the preferable range may include above described conventional equipment systems 1, 2.

As verified in the Example described later, while the plug having the arc-sprayed film produced in the conventional equipment system 1 exhibits a relatively enhanced durability life of the plug compared to the plug having a conventional scale film in common use, the level of enhancement of durability life may not always be sufficiently achieved. The reason for this is as follows.

Figure 6:
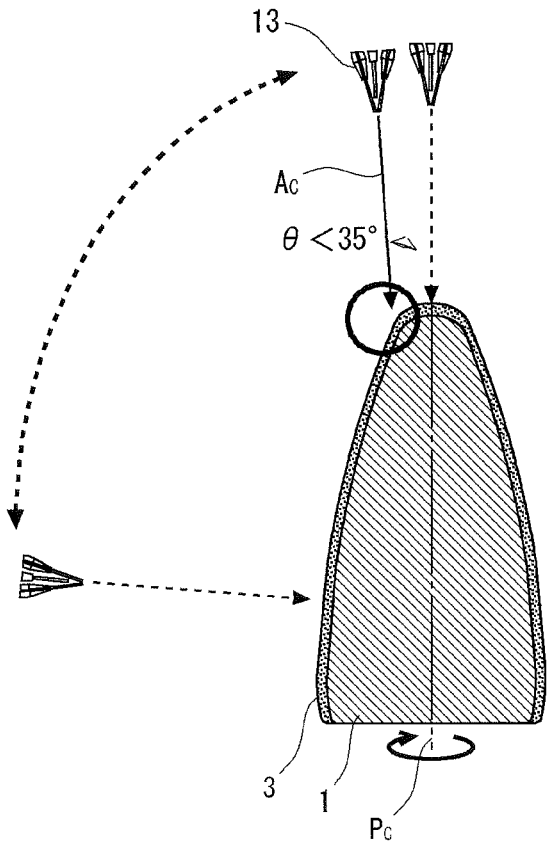
FIG. 6 is a schematic illustration showing the reason why enhancement of the durability life of the plug cannot be achieved by using the conventional equipment system 1 shown in FIG. 1.

FIG. 6 is a schematic illustration showing the reason why enhancement of the durability life of the plug cannot be achieved by using the conventional equipment system 1 shown in FIG. 1. In the conventional equipment system 1 shown in FIG. 1, the spray gun 13 is configured to move in a wide range from the rear end to the tip end of the surface of base metal of the plug 1, and thus it is extremely complicated to control the motion and the posture of the spray gun 13. Consequently, as shown in FIG. 6, if a slight deviation occurs in the position adjustment or the posture adjustment of the spray gun 13 relative to the plug base metal 2, the intersection angle θ between the center line Ac of the spraying stream from the arc-spray gun 13 and the surface of the plug base metal 2 may be deviated out of the above preferable range (encircled portion in FIG. 6). Due to this, the adhesiveness of the film becomes partially reduced.

In addition, the conventional equipment system 1 requires a huge spraying booth because the spray gun movable in a wide range is disposed in the spraying booth. Particularly, the conventional equipment system 1 operates a single spray gun in a wide range for the film formation, and the programming for controlling the operation becomes complicated, as well as it takes a longer time for the film formation, which deteriorates the production efficiency of the plug.

As verified in the Example described later, the durability life of the plug having the arc-sprayed film produced in the conventional equipment system 2 cannot be enhanced as much as expected, similarly to the conventional equipment system 1, and the reason for this is not identified yet. The conventional equipment system 2 requires a huge spraying booth because all the three spray guns are installed in the spraying booth. In addition, the conventional equipment system 2 forms the film by operating the three spray guns at the same time while preventing the spray guns from interfering with each other, which makes the programming for controlling various operations complicated.

Contrary to the conventional equipment systems 1 and 2 using the arc-spraying device having the sole spraying booth, and carrying out the film formation in the sole spraying booth, as verified in the Example described later, significant/sufficient enhancement of the durability life of the plug can be achieved by employing such an equipment system that divides the surface of the plug base metal into plural sections along an axial direction of the plug, and disposing plural booths for spraying as many as the number of divided sections, and forms the film such that the film formation is shared by the plural spraying booths wherein each divided section in turn, separately is subjected to the arc-spraying, thereby significantly enhancing the durability life of the plug.

In such an equipment system in which the formation of the entire film is shared by the plural spraying booths, the film formation can be sufficiently accomplished by providing only one spray gun operable in a small range in each spraying booth, thereby decreasing the size of the spraying booth. In addition, each spray gun operates in a small range and there is no interference with each other, which results in simplification of the programming for controlling various operations. Furthermore, the film formation is shared by the plural spraying booths, and is progressed in turn; thus it is possible to reduce the time required for forming the film in each section, thereby maintaining the overall production efficiency of the plug at a high level.

The present invention has been made based on the above findings. Hereinafter, description will be provided on the preferable embodiments of the equipment system for producing the plug of the present invention.

First Embodiment

Figure 7:
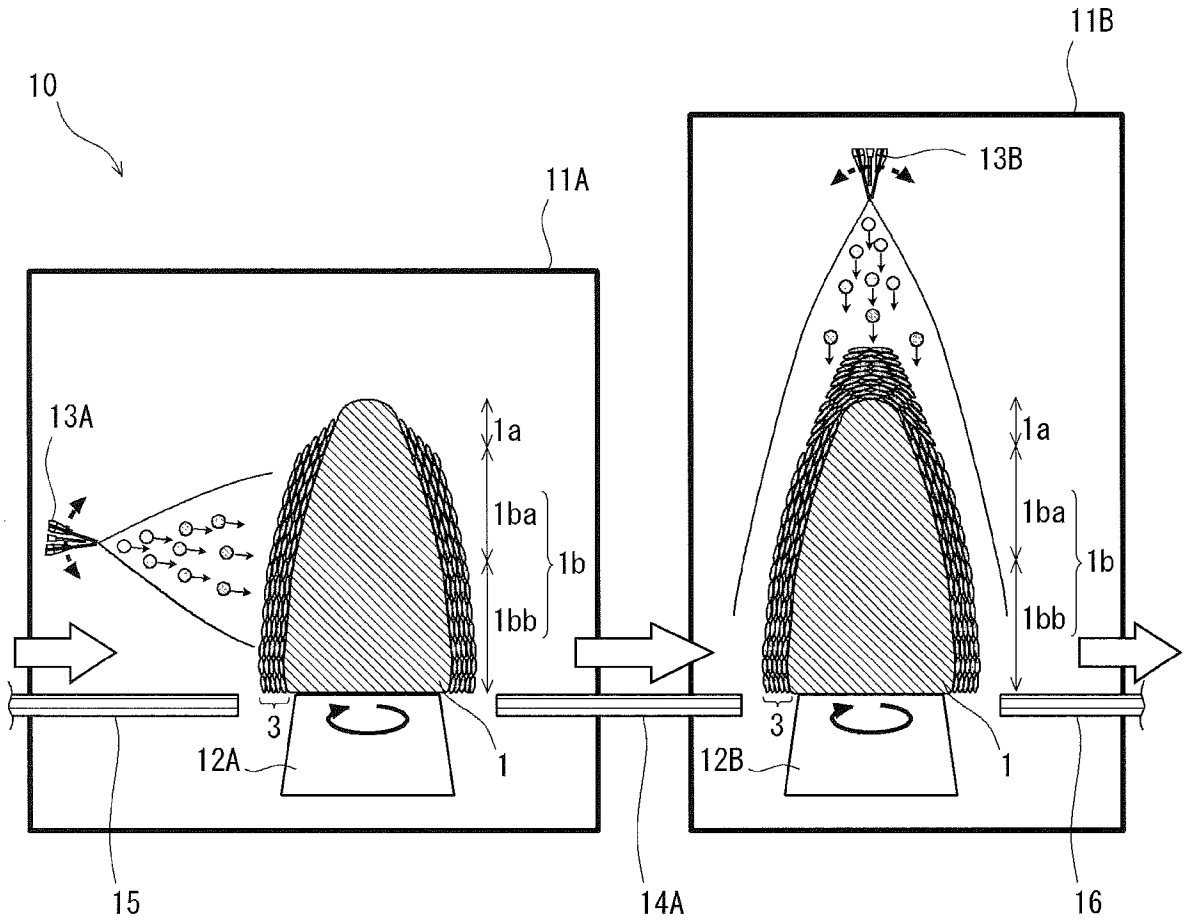
FIG. 7 is a schematic illustration showing an equipment system for producing the plug having the arc-sprayed film according to the first embodiment of the present invention.

FIG. 7 is a schematic illustration showing an equipment system for producing the plug having the arc-sprayed film according to the first embodiment of the present invention. The equipment system of the first embodiment shown in this illustration is based on the configurations of the conventional equipment systems 1 and 2 shown in FIG. 1 and FIG. 2, and duplicate description will be omitted where appropriate.

As shown in FIG. 7, the equipment system according to the present embodiment includes the arc-spraying device 10, and the shotblasting device (not shown) disposed prior to the arc-spraying device 10. The shotblasting device is the same as those in the conventional equipment systems 1 and 2.

In the present embodiment, the surface of the base metal of the plug 1 is divided into two sections along an axial direction of the plug 1. FIG. 7 shows an example of the plug 1 divided into the tip end portion 1*a* and the body portion 1*b*.

The arc-spraying device 10 of the present embodiment includes two spraying booths 11A and 11B as many as the number of divided sections of the surface of the base metal of the plug 1. These spraying booths 11A and 11B are arranged in series, and the plug 1 is fed into each spraying booth in turn. Hereinafter, in the equipment system of the present embodiment, the two spraying booths are referred to as a first spraying booth 11A and a second spraying booth 11B in the order of the feeding of the plug 1, wherein the plug 1 is subjected to shotblasting beforehand by the shotblast device.

Turntables 12A and 12B rotatable about their vertical axes are disposed respectively in first and second spraying booths 11A and 11B, and the plug 1 is vertically (with the tip end portion up) mounted at each center of the turntables 12A and 12B.

Furthermore, spray guns 13A and 13B each of which melts the iron wires by the arc, and sprays this molten material are disposed in a first and second spraying booths 11A and 11B, respectively. The spray gun 13A in a first spraying booth 11A (hereinafter, referred to as the "first spray gun" in the first embodiment) is configured to be opposite a region of the plug body portion 1*b* among the surface of the base metal of the plug 1, and reciprocatingly move along only this region. The spray gun 13B in a second spraying booth 11B (hereinafter, referred to as the "second spray gun" in the first embodiment) is configured to be opposite a region of the plug tip end portion 1*a* among the surface of the base metal of the plug 1, and reciprocatingly move along only this region. The two spray guns 13A and 13B are mounted to respective articulated arms that are separately operated by different programming.

In the equipment system of the present embodiment, in the formation of the film 3 on the surface of the base metal of the plug 1 by using the arc-spraying device 10, first, in the first spraying booth 11A, while the plug 1 is being rotated about its central axis along with the rotation of the turntable 12A, the first spray gun 13A is operated to carry out the arc-spraying to the plug 1. In this operation, the film 3 is formed on the body portion 1*b* other than the tip end portion 1*a* among the surface of the plug 1.

Next, the plug 1 on which the film 3 is formed in the first spraying booth 11A is fed into the second spraying booth 11B, and while the plug 1 is being rotated about its central axis along with the rotation of the turntable 12B, the second spray gun 13B is operated to carry out the arc-spraying to the plug 1. In this operation, the film 3 is formed on the tip end portion 1*a* among the surface of the plug 1. In this manner, the film 3 is formed across the entire surface of the plug 1.

In both the first and second spraying booths, the motion and the posture of each spray gun is controlled to carry out the arc-spraying such that the intersection angle between the center line of the spraying stream from each spray gun and the surface of the plug base metal is within the preferable range that is found based on the result of the above described basic tests, that is, within the range of 35 degrees to 90 degrees, more preferably of 60 degrees to 90 degrees.

As described above, the equipment system of the present embodiment can produce the plug having the arc-sprayed film in which the film containing oxide and Fe is formed across the entire surface of the plug base metal in such a manner that the iron wires are separately arc-sprayed on each of the two divided sections among the surface of the plug base metal in turn. Furthermore, this configuration makes it possible to reduce the operational range of each spray gun at the time of the arc-spraying in its divided section, thereby maintaining the above intersection angle within the preferable range without controlling the motion and posture of each spray gun in a complicated manner. As a result, it is possible to secure steady adhesiveness between the plug base metal and the film across the entire surface of the plug, as well as realize the stable durability life of the plug.

As shown in FIG. 7, in the equipment system of the present embodiment, the first spraying booth 11A and the second spraying booth 11B are disposed adjacent to each other, and a conveying line 14A is provided between the spraying booths 11A and 11B. This conveying line 14A delivers the plug 1 on which the film 3 is formed in the first spraying booth 11A to the second spraying booth 11B (see the white bold arrow in the illustration). The equipment system of the present embodiment further includes a conveying line 15 for feeding the plug to which the shotblasting is applied into the arc-spraying device 10 (the first spraying booth 11A), and a conveying line 16 for discharging the plug 1 on which the film 3 is formed in the second spraying booth 11B from the arc-spraying device 10.

The conveying lines 14A, 15 and 16 enable the plug 1 to be continuously fed into the arc-spraying device 10, and the film 3 to be formed onto the plug 1 without causing congestion of the plug 1 between the spraying booths 11A and 11B, and then discharge the plug 1, thereby further enhancing the overall production efficiency for the plug.

A shield plate may be disposed in each spraying booth so as to cover the plug other than a target region for the film formation in the spraying booth. Specifically, the shield plate is so disposed as to cover the tip end portion 1*a* in the first spraying booth 11A. The shield plate is so disposed as to cover the body portion 1*b* in the second spraying booth 11B. This is to prevent deterioration of the adhesiveness between the plug base metal and the film because the molten material sprayed from the spray gun adheres to an unexpected region at an unfavorable intersection angle. Hence, such a shield plate may be provided at least in the first spraying booth 11A, and unnecessary to be provided in the second spraying booth 11B.

In FIG. 7, the film 3 formed on the surface of the base metal of the plug 1 has a heavier thickness at the tip end portion 1*a* than the body portion 1*b* of the plug. The film 3 may be uniformly formed across the entire range of the surface of the base metal of the plug 1, instead. The film 3 having the heavier thickness at the tip end portion of the plug is useful in light of securing enhancement of thermal insulation performance and wear resistance of the film at the tip end portion of the plug where the surfacial pressure becomes high and temperature is increased during the piercing-rolling, so that further enhancement of the durability life of the plug can be expected.

In the equipment system of the present embodiment, the spray gun disposed in each spraying booth is configured to reciprocatingly move along the surface of the plug base metal as well as to be gradually distanced away from the surface of the plug base metal. Through this complex movement, such a film is formed on the plug base metal that gradually increases in the proportion of the oxide region toward the surface (referred to as the "oxide proportion", hereinafter). The film having a smaller oxide proportion at a portion adjacent to the plug base metal, and having a greater proportion on the surface thereof is useful in light of securing thermal insulation performance and seizing preventing performance on the surface of the film as well as securing adhesiveness at the portion adjacent to the plug base metal.

Second Embodiment

Figure 8:
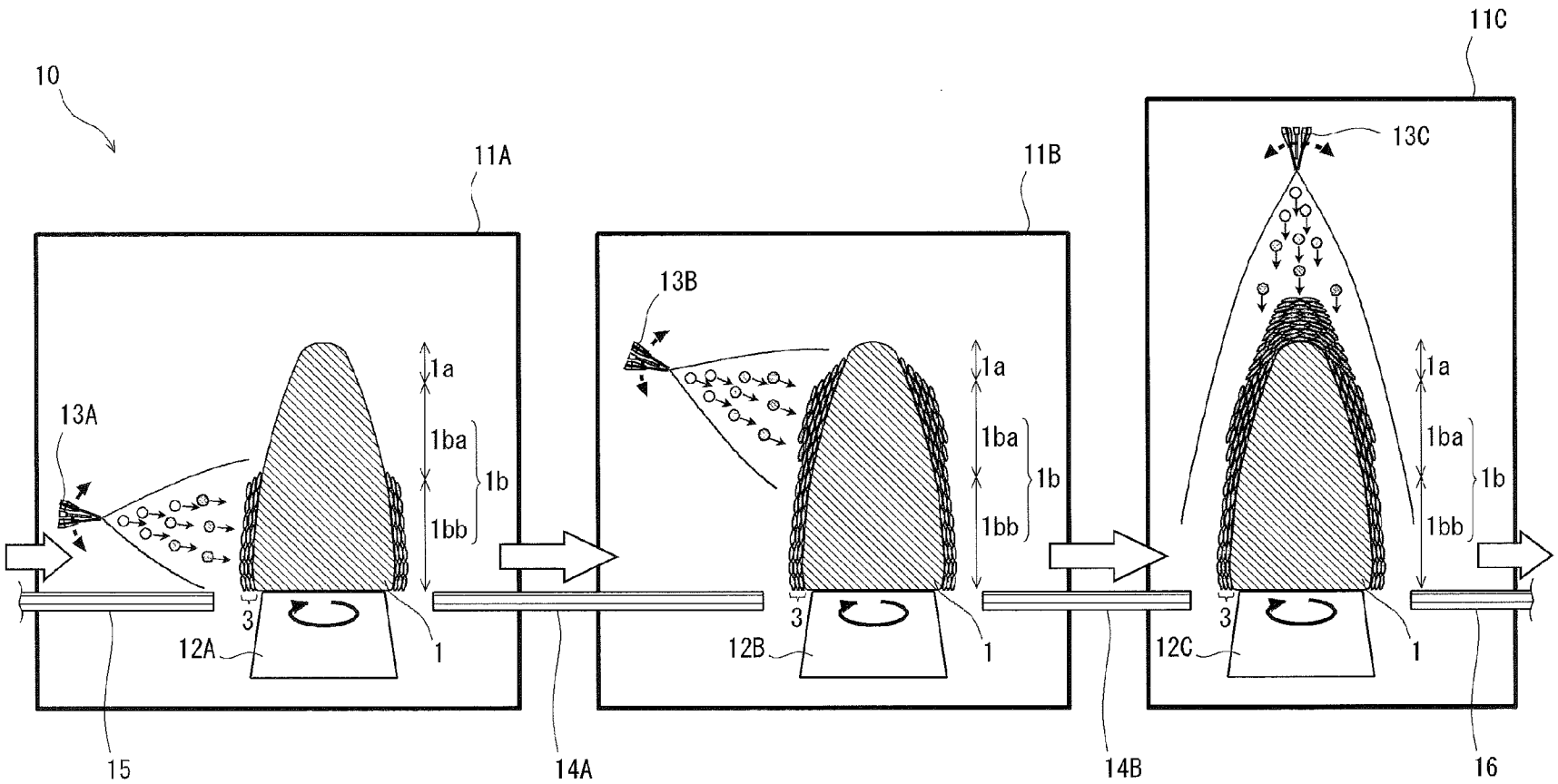
FIG. 8 is a schematic illustration showing an equipment system for producing the plug having the arc-sprayed film according to the second embodiment of the present invention.

FIG. 8 is a schematic illustration showing the equipment system for producing the plug having the arc-sprayed film according to the second embodiment of the present invention. This equipment system is different from the equipment system of the first embodiment in the following features.

The equipment system of the present embodiment allows the number of divided sections of the surface of the base metal of the plug 1 to be further increased. Specifically, in the present embodiment, the surface of the base metal of the plug 1 is divided into three sections along an axial direction of the plug 1. FIG. 8 shows an example in which the surface of the base metal of the plug 1 is divided into the tip end portion 1*a*, a front-half 1*ba* of the body portion, and a rear-half 1*bb* of the body portion.

The arc-spraying device 10 of the present embodiment includes three spraying booths 11A, 11B and 11C as many as the number of divided sections of the surface of the base metal of the plug 1 in order to form the film 3. These spraying booths 11A, 11B and 11C are arranged in series, and the plug 1 is fed into each spraying booth in turn. Hereinafter, the three spraying booths are referred to as the first spraying booth 11A, the second spraying booth 11B, and the third spraying booth 11C in the order of the feeding of the plug 1 to which the shotblasting is applied by the shotblasting device. The third spraying booth 11C of the present embodiment corresponds to the second spraying booth 11B of the first embodiment.

Turntables 12A, 12B and 12C rotatable about their vertical axes are disposed in the first, second, and third spraying booths 11A, 11B and 11C, and the plug 1 is vertically (with the tip end portion up) mounted at each center of the turntables 12A, 12B and 12C.

Furthermore, spray guns 13A, 13B and 13C each of which melts the iron wires by the arc, and sprays this molten material are disposed in the respective first and second and third spraying booths 11A, 11B and 11C. The spray gun 13A in the first spraying booth 11A (hereinafter, referred to as the "first spray gun" in the second embodiment) is configured to be opposite a region of the rear-half 1*bb* of the plug body portion 1*b* among the surface of the base metal of the plug 1, and reciprocatingly move along only this region. The spray gun 13B in the second spraying booth 11B (hereinafter, referred to as the "second spray gun" in the second embodiment) is configured to be opposite a region of the front-half 1*ba* of the plug body portion 1*b* among the surface of the base metal of the plug 1, and reciprocatingly move along only this region. The spray gun 13C in the third spraying booth 11C (hereinafter, referred to as the "third spray gun" in the second embodiment) is configured to be opposite a region of the plug tip end portion 1*a* of the surface of the base metal of the plug 1, and reciprocatingly move along only this region. These three spray guns 13A, 13B and 13C are mounted to respective articulated arms that are separately operated by different programming.

In the equipment system of the present embodiment, in the formation of the film 3 on the surface of the base metal of the plug 1 by using the arc-spraying device 10, first, in the first spraying booth 11A, the plug 1 is rotated about its central axis along with the rotation of the turntable 12A, and the first spray gun 13A is then operated to carry out the arc-spraying to the plug 1. In this operation, the film 3 is formed on the rear-half 1*bb* of the body portion other than the tip end portion 1*a* and the front-half 1*ba* of the body portion among the surface of the plug 1.

Followed by the above operation, the plug 1 on which the film 3 is formed in the first spraying booth 11A is fed into the second spraying booth 11B, and the plug 1 is rotated about its central axis along with the rotation of the turntable 12B, and the second spray gun 13B is then operated to carry out the arc-spraying to the plug 1. In this operation, the film 3 is formed on the front-half 1*ba* of the body portion among the surface of the plug 1.

Next, the plug 1 on which the film 3 is formed in the second spraying booth 11B is fed into the third spraying booth 11C, and the plug 1 is rotated about its central axis along with the rotation of the turntable 12C, and the third spray gun 13C is then operated to carry out the arc-spraying to the plug 1. In this operation, the film 3 is formed on the tip end portion 1*a* among the surface of the plug 1. In this manner, the film 3 is formed across the entire surface of the plug 1.

In all the first to third spraying booths, the motion and the posture of each spray gun is controlled to carry out the arc-spraying such that the intersection angle between the center line of the spraying stream of each spray gun and the surface of the plug base metal is within the preferable range that is found based on the result of the above described basic tests.

As described above, the equipment system of the present embodiment can produce the plug having the arc-sprayed film in which the film containing oxide and Fe is formed across the entire surface of the plug base metal in such a manner that the iron wires are separately arc-sprayed on each of the three divided sections among the surface of the plug base metal in turn.

As shown in FIG. 8, in the equipment system of the present embodiment, the first spraying booth 11A and the second spraying booth 11B are disposed adjacent to each other, the second spraying booth 11B and the third spraying booth 11C are disposed adjacent to each other, and a conveying line 14A is provided between the first spraying booth 11A and the second spraying booth 11B, and a conveying line 14B is provided between the second spraying booth 11B and the third spraying booth 11C. The conveying line 14A delivers the plug 1 on which the film 3 is formed in the first spraying booth 11A to the second spraying booth 11B, and the conveying line 14B delivers the plug 1 on which the film 3 is formed in the second spraying booth 11B to the third spraying booth 11C (see the white bold arrow in the illustration). The equipment system of the present embodiment further includes a conveying line 15 for feeding the plug to which the shotblasting is applied into the arc-spraying device 10 (the first spraying booth 11A), and a conveying line 16 for discharging the plug 1 on which the film 3 is formed in the third spraying booth 11C from the arc-spraying device 10.

Similarly to the first embodiment, the conveying lines 14A, 14B, 15 and 16 enable the plug 1 to be continuously fed into the arc-spraying device 10, and the film 3 to be formed onto the plug 1 without causing congestion of the plug 1 between the spraying booths 11A, 11B and 11C, and then discharge the plug 1, thereby further enhancing the overall production efficiency for the plug.

Similarly to the first embodiment, a shield plate may be disposed in each spraying booth so as to cover the plug other than a target region for the film formation in the spraying booth. Specifically, the shield plate is so disposed as to cover the tip end portion 1*a* and the front-half 1*ba* of the body portion in the first spraying booth 11A. The shield plate is so disposed as to cover the tip end portion 1*a* and the rear-half 1*bb* of the body portion in the second spraying booth 11B. The shield plate is so disposed as to cover the front-half 1*ba* and the rear-half 1*bb* of the body portion in the third spraying booth 11C. For the same reason as the above, such a shield plate may be provided at least in the first spraying booth 11A and the second spraying booth 11B so as to cover the tip end portion 1*a*, and unnecessary to be provided in the third spraying booth 11C.

The number of the divided sections of the surface of the plug base metal may be more than one, and the number of the spray guns may be determined in accordance with the number of the divided sections.

EXAMPLE

For the purpose of verifying the effects of the present invention, a piercing-rolling test was conducted in such a manner that plugs for piercing-rolling were produced, and each of the produced plugs was mounted to a piercer so as to carry out the piercing-rolling. The test condition was as follows.

[Test Method]

(1) Production of Plugs

A number of bullet-shaped plugs, each having a maximum diameter of 57 mm, were produced using hot-working tool steel specified by JIS standard as the base metal. Plugs having the arc-sprayed film were produced in such a manner that the shotblasting was applied to each plug by using the equipment systems of the first and second embodiments as shown in FIG. 7 and FIG. 8, and thereafter, the arc-spraying was carried out by using iron wires so as to form a film on the surface of the base metal of each plug.

For comparison, plugs having the arc-sprayed films were produced by using the conventional equipment systems 1 and 2 shown in FIG. 1 and FIG. 2. In addition to this, plugs having scale films were produced by forming the oxide scale film on the surface of the base metal of each plug through a heat treat furnace.

In the formation of the arc-sprayed film, the arc-spraying was conducted for each plug with the spraying distance, i.e., standoff distance, from the spray gun to the surface of the plug base metal initially set to 200 mm, and the arc-spraying was carried out while the spray gun was gradually distanced away from the surface of the plug base metal until the spraying distance finally became 1000 mm. The film thickness of each plug having the arc-sprayed film was set to 500 μm at the plug body portion (front-half and rear-half), and to 1500 μm at the plug tip end portion. The film thickness of each plug having the scale film was set to 600 μm across the entire plug.

(2) Piercing-Rolling

Using the above various plugs, the following hollow shells were produced by repetitively piercing-rolling the following workpieces (materials) heated at 1200° C.

Workpiece size: round billet of 70 mm in diameter and 1000 mm in length

Workpiece material grade: SUS304

Hollow shell: 74 mm in outer diameter, 8.6 mm in wall thickness, 2200 mm in length.

[Evaluating Method]

(1) Production Efficiency of Plug

In case of forming an arc-sprayed film onto the plug, ten plugs were fed one by one continuously in each equipment system, and the number of plugs that could be produced per hour was counted. For the case of forming the scale film onto the plug, fifteen plugs were heat-treated in a batch-type heat treat furnace at a time, and the number of plugs that could be produced per hour was counted. The production efficiency of the plug was evaluated based on the number of producible plugs per hour.

(2) Durability Life of Plug

Inspection was conducted on the appearance of each plug every time the piercing-rolling was completed. For each plug, the number of pass counts until the plug became unusable due to the detachment of the film, or melting-incurred metal loss or deformation was generated at the tip end of the plug was investigated, in other words, the number of billets that successfully were subjected to the continuous piercing-rolling (the number of times of the continuous piercing-rolling) was counted. The number of times of continuous piercing-rolling was evaluated as the durability life of the plug.

[Test Result]

Test result is shown in Table 1.

TABLE 1

| Test No | Classification | Film | Number of Spraying Booths | Number of Spray Guns in Spraying Booth | Film Thickness [μm] Body | Film Thickness [μm] Tip End | Number of Producible Plugs (/hr.) | Number of Times of Continuous Piercing-rolling |
|---|---|---|---|---|---|---|---|---|
| 1 | Comparative Example | Scale Film | — | — | 600 | 600 | 2 | 2 |
| 2 | Comparative Example | Arc-sprayed Film | 1 | 1 | 500 | 1500 | 2 | 6 |
| 3 | Comparative Example | Arc-sprayed Film | 1 | 3 | 500 | 1500 | 6 | 4 |
| 4 | Inventive Example | Arc-sprayed Film | 2 | 1 | 500 | 1500 | 5 | 14 |
| 5 | Inventive Example | Arc-sprayed Film | 3 | 1 | 500 | 1500 | 7 | 15 |

The Test Nos. 1 to 3 represent Comparison Examples, and Test Nos. 4 and 5 represent Inventive Examples of the present invention.

In Test No. 1, the test was conducted on the plug having the scale film formed through the heat treatment. Consequently, the number of producible plugs was merely two per hour. In this case, the number of times of continuous piercing-rolling was two, which is a significantly small.

In Test No. 2, the test was conducted on the plug having the arc-sprayed film formed by using the conventional equipment system 1 shown in FIG. 1 that operated a single spray gun in single spraying booth. Consequently, the number of producible plugs was merely two per hour. In this case, not a few effects of the arc-sprayed film were observed, and the number of times of continuous piercing-rolling became six.

In Test No. 3, the test was conducted on the plug having the arc-sprayed film formed by using the conventional equipment system 2 shown in FIG. 2 that operated three spray guns at the same time in single spraying booth. Consequently, the number of producible plugs was increased to six per hour. Again, not a few effects of the arc-sprayed film were observed, and the number of times of continuous piercing-rolling became four.

For comparison with the above Comparative Examples, in Test No. 4, the test was conducted on the plug having the arc-sprayed film formed by using the equipment system of the first embodiment shown in FIG. 7, in which the film formation was shared by two spraying booths each of which accommodated single spray gun. Specifically, the surface of the plug base metal was divided into two sections along an axial direction of the plug, and the film formation was shared by the two spraying booths so as to separately form the film in each section in turn. Consequently, the number of producible plugs could be maintained at five per hour. In this case, the number of times of continuous piercing-rolling could be increased to fourteen, which exhibited significant increase.

In Test No. 5, the test was conducted on the plug having the arc-sprayed film formed by using the equipment system of the second embodiment shown in FIG. 8, in which the film formation was shared by three spraying booths each of which accommodated single spray gun. Specifically, the surface of the plug base metal was divided into three sections along an axial direction of the plug, and the film formation was shared by the three spraying booths so as to separately form the film in each section in turn. Consequently, the number of producible plugs was increased to seven per hour. In this case, the number of times of continuous piercing-rolling was fifteen, which exhibited further significant increase.

Based on the above result, it is apparent that the production efficiency of the plug can be maintained at a high level, and steady enhancement of the durability life of the plug was realized during the piercing-rolling by employing such an equipment system that divides the surface of the plug base metal into plural sections along an axial direction of the plug, and includes the plural spraying booths each of which separately forms the film in its divided section in turn.

INDUSTRIAL APPLICABILITY

The present invention can be effectively used in production of a seamless steel tube/pipe of high alloy steel.

REFERENCE SIGNS LIST

1: Plug
1*a*: Tip end portion of plug
1*b*: Body portion of plug
1*ba*: Front-half of body portion of plug
1*bb*: Rear-half of body portion of plug
3: Arc-sprayed film
10: Arc-spraying device
11, 11A, 11B, 11C: Spraying booths
12, 12A, 12B, 12C: Turntables
13, 13A, 13B, 13C: Arc-spray guns
14A, 14B, 15, 16: Conveying lines
Pc: Central axis of plug
Ac: Center line of spraying stream of arc-spray gun
θ: Intersection angle

What is claimed is:

1. An equipment system for producing a piercing-rolling plug to be used for producing a seamless steel tube/pipe, the equipment system comprising:

a shotblasting device for applying shotblasting on a surface of the plug, the plug having an axis defining an axial direction, the plug being divided along the axial direction of the plug into sections, and an arc-spraying device for performing arc-spraying of iron wires on a surface of a base metal of the plug to which the shotblasting is applied, so as to form a film containing oxide and Fe thereon, wherein the arc-spraying device includes plural spraying booths each of which is used to separately and sequentially forma part of the film in each of the sections into which the surface of the base metal of the plug is divided along the axial direction of the plug.

2. The equipment system for producing a piercing-rolling plug according to claim 1, wherein an arc-spray gun for melting the iron wires by an arc to produce a molten material and spraying the molten material onto the surface of the base metal of the plug is disposed in each arc-spraying booth, and the arc-spraying is carried out while an intersection angle between a center line of a spraying stream from the arc-spray gun and the surface of the base metal of the plug is maintained in a range of 35 degrees to 90 degrees.

3. The equipment system for producing a piercing-rolling plug according to claim 1, wherein the plug has a bullet shape, and includes a body portion and a tip end portion, and the arc-spraying device includes, as the spraying booths, a first spraying booth for carrying out a first film formation in a region of the body portion among the surface of the base metal of the plug; and a second spraying booth for carrying out a second film formation in a region of the tip end portion among the surface of the base metal of the plug.

4. The equipment system for producing a piercing-rolling plug according to claim 2, wherein the plug has a bullet shape, and includes a body portion and a tip end portion, and the arc-spraying device includes, as the spraying booths, a first spraying booth for carrying out a first film formation in a region of the body portion among the surface of the base metal of the plug; and a second spraying booth for carrying out a second film formation in a region of the tip end portion among the surface of the base metal of the plug.

5. The equipment system for producing a piercing-rolling plug according to claim 1, wherein further comprising a conveying line for moving the plug between the spraying booths.

6. The equipment system for producing a piercing-rolling plug according to claim 2, wherein further comprising a conveying line for moving the plug between the spraying booths.

7. The equipment system for producing a piercing-rolling plug according to claim 3, wherein further comprising a conveying line for moving the plug between the spraying booths.

8. The equipment system for producing a piercing-rolling plug according to claim 4, wherein further comprising a conveying line for moving the plug between the spraying booths.

* * * * *